US008259149B2

(12) United States Patent
Kinoshita

(10) Patent No.: US 8,259,149 B2
(45) Date of Patent: Sep. 4, 2012

(54) METHOD AND APPARATUS FOR IMAGE FORMING, AND COMPUTER PROGRAM PRODUCT

(75) Inventor: Izumi Kinoshita, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 837 days.

(21) Appl. No.: 12/275,787

(22) Filed: Nov. 21, 2008

(65) Prior Publication Data

US 2009/0136264 A1 May 28, 2009

(30) Foreign Application Priority Data

Nov. 27, 2007 (JP) ..... 2007-306427
Oct. 31, 2008 (JP) ..... 2008-281939

(51) Int. Cl.
*B41J 27/00* (2006.01)
*B41J 2/435* (2006.01)

(52) U.S. Cl. ..... 347/261; 347/259; 347/260; 347/243; 347/236; 347/246

(58) Field of Classification Search ..... 347/234, 347/246, 236, 243, 259–261
See application file for complete search history.

(56) References Cited

U.S. PATENT DOCUMENTS 6,252,618 B1 * 6/2001 Coriale et al. ..... 347/116
6,493,010 B1 * 12/2002 Takahashi et al. ..... 347/116
2004/0065820 A1 * 4/2004 Yamaguchi ..... 250/234
2007/0206256 A1 * 9/2007 Itabashi ..... 359/196
2008/0062495 A1 * 3/2008 Ku ..... 359/216
2008/0273896 A1 11/2008 Kinoshita

FOREIGN PATENT DOCUMENTS

JP 2003-266785 9/2003
JP 2003-270581 9/2003
JP 2005-292377 10/2005
JP 2007-163789 6/2007

* cited by examiner

*Primary Examiner* — Stephen Meier
*Assistant Examiner* — Sarah Al Hashimi
(74) *Attorney, Agent, or Firm* — Oblon, Spivak, McClelland, Maier & Neustadt, L.L.P.

(57) ABSTRACT

An image forming apparatus includes a light source, a polygon mirror, and a plurality of photosensitive elements. The polygon mirror has a plurality of reflection surfaces that reflect a light beam at different angles. The light beams deflected by the reflection surfaces travel along different optical paths and impinge on different photosensitive elements. A light-beam control unit controls emission of the light beam from the light source depending on a distance between the deflecting unit and the photosensitive elements thereby performing an fθ correction of the light beam.

3 Claims, 8 Drawing Sheets

METHOD AND APPARATUS FOR IMAGE FORMING, AND COMPUTER PROGRAM PRODUCT

CROSS-REFERENCE TO RELATED APPLICATIONS

The present application claims priority to and incorporates by reference the entire contents of Japanese priority document 2007-306427 filed in Japan on Nov. 27, 2007 and Japanese priority document 2008-281939 filed in Japan on Oct. 31, 2008.

BACKGROUND OF THE INVENTION

1. Field of the Invention

The present invention relates to a technology for exposing a plurality of photosensitive elements to laser beams to form an image.

2. Description of the Related Art

A typical image forming apparatus, e.g., a color electrophotographic printer including a plurality of photosensitive elements (drums), uses a tandem method to form a full-color image. This type of image forming apparatus generally transfers images of different colors formed on the photosensitive elements to a recording medium such as paper in a superimposing manner to obtain a full-color image. An example of such an image forming apparatus is disclosed in Japanese Patent Application Laid-open No. 2007-163789.

FIG. 9 is an exemplary schematic diagram of relevant parts of a conventional image forming apparatus 100. FIG. 10 is a block diagram of relevant parts of the image forming apparatus 100.

The image forming apparatus 100 includes an intermediate transfer belt 2, four photosensitive elements 11K, 11Y, 11M, and 11C for black (K), yellow (Y), magenta (M), and cyan (C), respectively, and a polygon mirror 101. The intermediate transfer belt 2 is driven to rotate. The photosensitive elements 11K, 11Y, 11M, and 11C are arranged in this order on an upper surface of the intermediate transfer belt 2 along a rotating direction of the intermediate transfer belt 2. The photosensitive elements 11K, 11Y, 11M, and 11C are accompanied by charging units 12K, 12Y, 12M, and 12C and developing units 13K, 13Y, 13M, and 13C, respectively. The polygon mirror 101 deflects on its surface light beams BK, BY, BM, and BC so that the light beams impinge on the photosensitive elements 11K, 11Y, 11M, and 11C for exposure, respectively. The polygon mirror 101 includes an upper polygon mirror 101A and a lower polygon mirror 101B, each of which has six reflection side surfaces. The polygon mirror 101 is placed between a pair of fθ lenses 102. More specifically, the upper polygon mirror 101A is placed between a pair of upper fθ lenses 102A, and the lower polygon mirror 101B is placed between a pair of lower fθ lenses 102B.

Referring to FIG. 10, the image forming apparatus 100 includes a polygon-mirror control unit 32, laser-diode (LD) control units 31-1 and 31-2, scan-start-synchronization control units 34-1 and 34-2, and a scan-end-synchronization control unit 37. The polygon-mirror control unit 32 controls the polygon mirror 101. The LD control units 31-1 and 31-2 control LDs 30K, 30Y, 30M, and 30C. The scan-start-synchronization control units 34-1 and 34-2 perform synchronization control of a light beam based on detection of the light beam near a scan-start position by scan-start-synchronization control sensors 33-1 and 33-2. The scan-end-synchronization control unit 37 performs synchronization control of a light beam based on detection of the light beam near a scan-start position by a scan-end-synchronization control sensor 36.

The image forming apparatus 100 includes a reference clock generator 41, a frequency divider (M) 42, a frequency divider (N) 43, a phase-locked loop (PLL) 44, and a central processing unit (CPU) 40. The reference clock generator 41 generates a reference clock. The frequency divider (M) 42, the frequency divider (N) 43, and the PLL 44 control (change) a clock speed of the reference clock. For example, the frequency divider (M) 42, the frequency divider (N) 43, and the PLL 44 change (adjust) a pixel clock based on the reference clock received from the reference clock generator 41. The CPU 40 performs various data processing, calculation, and control operations of the image forming apparatus 100.

In the image forming apparatus 100, the polygon mirror 101 is rotated to deflect the light beams BK, BY, BM, and BC so that the light beams BK, BY, BM, and BC scan the photosensitive elements 11K, 11Y, 11M, and 11C, respectively, for exposure. Thereafter, the developing units 13K, 13Y, 13M, and 13C form (develop) toner images of K, Y, M, and C on the photosensitive elements 11K, 11Y, 11M, and 11C, respectively. The toner images are sequentially primary-transferred to the intermediate transfer belt 2 and overlaid on one another to form a full-color image. The intermediate transfer belt 2 is rotated to feed a recording medium P so that the thus-formed full-color image is secondary-transferred to the recording medium P. Hence, a full-color image is formed on the recording medium P.

Referring to FIGS. 9 and 10, in the image forming apparatus 100, the LDs 30K, 30Y, 30M, and 30C generate and emit light beams toward the reflection surfaces of the upper polygon mirror 101A and the lower polygon mirror 101B of the polygon mirror 101. The polygon mirror 101 is rotated. The direction in which the light beams impinge on the reflection surfaces of the upper polygon mirror 101A is opposite to the direction in which the light beams impinge on the reflection surfaces of the lower polygon mirror 101B. Each of the light beams is reflectively deflected by one of the six reflection surfaces of the upper polygon mirror 101A and the six reflection surfaces of the lower polygon mirror 101B. The reflectively-deflected light beam raster-scans one of the photosensitive elements 11K, 11Y, 11M, and 11C for exposure. Put another way, rotation of the polygon mirror 101 causes the light beam to sweep (hereinafter, "raster scan") the photosensitive element in the main-scanning direction, while the rotation of the photosensitive element causes the light beam to relatively shift in the sub-scanning direction.

Because the polygon mirror 101 rotates about its rotary axis at a constant angular velocity, a scan speed of the light beam moving on the photosensitive element in the main-scanning direction for raster scan is not constant. Accordingly, when the LDs 30K, 30Y, 30M, and 30C emit at constant time intervals, resultant pixels may vary from one another in length and the like in the main-scanning direction, which leads to uneven dots. To this end, in the conventional image forming apparatus 100, the deflected light beams are subjected to fθ correction by using the fθ lenses 102 to convert the constant angular-velocity scanning into constant velocity scanning. Pixels resulting from the constant velocity scanning are identical to one another in length and the like.

As described above, in typical conventional image forming apparatuses, one or more LDs are provided for a single photosensitive element. Raster scan is performed by causing light beams, which are emitted from the LDs 30K, 30Y, 30M, and 30C, to be reflected from all the reflection surfaces that are arranged along the rotating direction of the polygon mirror 101. The raster scan and rotation of the polygon mirror are alternately repeated to expose an image. However, the conventional image forming apparatus is disadvantageous in that the number of components and a footprint for an optical system are relatively large. Therefore, the conventional image forming apparatuses can be expensive and require large footprint.

The reflection angles of the reflection surfaces of the polygon mirror 101 can fail to be identical to one another due to a dimensional error developed during the manufacturing process. Hence, it is required to correct the reflection angle of each of the reflection surfaces; that is, to perform optical-face-angle error correction. This optical-face-angle error correction is typically performed by using the fθ lens 102, which is an important element in terms of image quality as well. However, relatively-high prices of fθ lenses employed in typical image forming apparatuses have been one of the causes of relatively-high prices of the conventional image forming apparatuses. To this end, relatively-inexpensive fθ lenses made of resin can be employed; however, because resin fθ lenses are inferior to the conventionally-employed fθ lenses in temperature characteristics and optical characteristics, the resin fθ lenses can cause image quality to reduce.

As shown in FIG. 10, the image forming apparatus 100 include reflection mirrors 33M-1 and 33M-2 and the scan-start-synchronization control (detecting) sensors 33-1 and 33-2 that detect light beams for synchronization. A scan-start position of a light beam in the main-scanning direction is adjusted based on detection of the light beam by the scan-start-synchronization control sensors 33-1 and 33-2 for synchronization. However, to perform such synchronization control, it is necessary to locate the scan-start-synchronization control sensors 33-1 and 33-2 outside an image writing area so that each of the scan-start-synchronization control sensors 33-1 and 33-2 can detect a portion of a deflected light beam. Due to this arrangement, a ratio of a width of the image writing area to a stroke length (hereinafter, "raster-scan stroke") of a light beam moving across the raster scan area in the main-scanning direction decreases. The ratio will be referred to as "effective scan ratio". The effective scan ratio is obtained from the following equation:

Effective scan ratio=(image writing area)/(raster scan area).

The effective scan ratio can also be calculated from the following equation, which is obtained from the above equation:

Effective scan ratio=(number of dots to be written/write frequency)/(time duration of one turn of polygon mirror/number of reflection surfaces of polygon mirror along rotating direction).

The value of (time duration of one turn of polygon mirror/number of reflection surfaces of polygon mirror along rotating direction) depends on a resolution in the sub-scanning direction and a linear velocity (i.e., the scan speed in the main-scanning direction, hereinafter, "main-scan speed"); and the (number of dots to be written) depends on a width of the image writing area in the main-scanning direction and a resolution in the same direction. When the effective scan ratio decreases, it is required to increase the value of (write frequency) to compensate for a drop in the effective scan ratio. However, as the write frequency increases, not only does power consumption increase but also unnecessary radiation increases, which can result in build-up of cost such as running cost.

In the image forming apparatus 100, the scan-end-synchronization control (detecting) sensor 36 and a reflection mirror 36M are located near a scan-end position. Synchronization control of a light beam is performed based on detection of the light beam at the scan-end region by the scan-end-synchronization control sensor 36. Through such synchronization control, a magnification in the main-scanning direction and registration errors in the sub-scanning direction due to a temperature rise can be corrected, and an accuracy of scanning is increased. As described above, in a conventional technology, the scan-end-synchronization control sensor 36 has been provided in addition to the scan-start-synchronization control sensors 33-1 and 33-2. However, by additionally providing the scan-end-synchronization control sensor 36, a ratio of the image writing area is further decreased, unfavorably resulting in an upsizing of an optical system and upsizing of an image forming apparatus that incorporates the optical system.

To this end, the image forming apparatuses disclosed in Japanese Patent Application Laid-open No. 2003-266785, Japanese Patent Application Laid-open No. 2003-270581, and Japanese Patent Application Laid-open No. 2005-292377, include a polygon mirror having a plurality of reflection surfaces each slanting by either a first reflection angle or a second reflection angle. The reflection surfaces are arranged such that reflection surfaces having the first reflection angle and the other reflection surfaces having the second reflection angle are radially aligned in an alternating order. A light beam emitted from a light source is reflectively deflected by one of the reflection surfaces, causing the light beam to travel along one of different optical paths. The optical path is determined depending on the reflection surface. Each of a plurality of photosensitive elements is scanned with the light beam having passed through an fθ lens.

The conventional image forming apparatuses are downsized by reducing the number of light sources and the like to reduce the number of required parts as well as to reduce cost for the eliminated parts. However, the conventional image forming apparatus does not only have one or more expensive fθ lenses but also the problem pertaining to arrangement of the scan-start-synchronization control sensors 33-1, 33-2, and the scan-end-synchronization control sensor 36. Hence, there is room to further reduce the number of required parts for cost reduction and downsizing.

SUMMARY OF THE INVENTION

It is an object of the present invention to at least partially solve the problems in the conventional technology.

According to an aspect of the present invention, there is provided an image forming apparatus that forms an image according to image data. The image forming apparatus includes a light source that emits a light beam according to the image data; a deflecting unit that receives the light beam from the light source and deflects the light beam in a main-scanning direction; a plurality of photosensitive elements that are exposed to the light beam received from the deflecting unit; and a light-beam control unit that controls emission of the light beam from the light source depending on a distance between the deflecting unit and the photosensitive elements, thereby performing an fθ correction of the light beam.

According to another aspect of the present invention, there is provided an image forming method to be implemented on an image forming apparatus that forms an image according to image data. The image forming method includes providing a light source that emits a light beam according to the image data; providing a deflecting unit that receives the light beam from the light source and deflects the light beam in a main-scanning direction; providing a plurality of photosensitive elements that are exposed to the light beam received from the deflecting unit; and controlling emission of the light beam from the light source depending on a distance between the deflecting unit and the photosensitive elements, thereby performing an fθ correction of the light beam.

According to still another aspect of the present invention, there is provided a computer program product that causes a computer to implement the above method.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

An image forming apparatus according to a first embodiment of the present invention causes a light beam emitted from a light source to be deflected by a deflecting unit and impinge on one of a plurality of photosensitive elements for exposure. The image forming apparatus can be, for example, a digital copier or a laser printer that forms a full-color image. As a specific example of such an image forming apparatus, an image forming apparatus 1 of a tandem type that includes four photosensitive drums as the photosensitive elements to form a color image in toners of four colors on a recording medium will be described below. Meanwhile, the number of the photosensitive elements is not limited to four.

Figure 1:
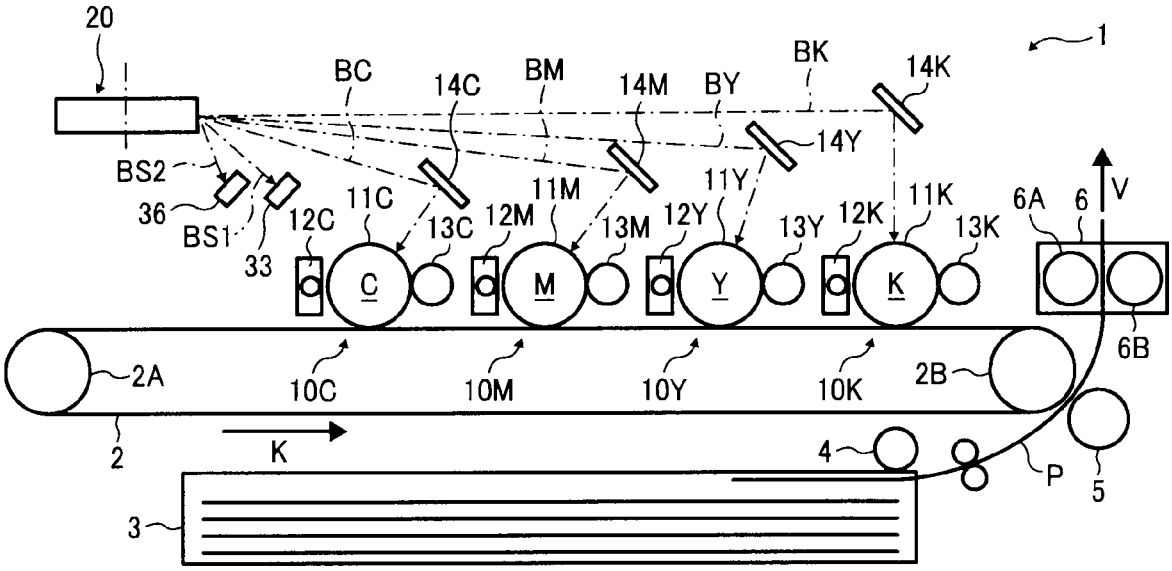
FIG. 1 is a schematic diagram of an image forming apparatus according to a first embodiment of the present invention.

FIG. 1 is a schematic diagram of the image forming apparatus 1. The image forming apparatus 1 includes the intermediate transfer belt 2, electrophotographic processing units 10K, 10Y, 10M, and 10C on an upper surface of the intermediate transfer belt 2, and an optical scanning unit 20. The optical scanning unit 20 is located above the electrophotographic processing units 10K, 10Y, 10M, and 10C and includes a polygon mirror 21. The image forming apparatus 1 further includes a feed tray 3, a paper feed roller 4, a secondary transfer roller 5, and a fixing unit 6. The intermediate transfer belt 2, the secondary transfer roller 5, and the fixing unit 6 are provided in this order along a paper feed path of the recording medium P. The secondary transfer roller 5 is located on the intermediate transfer belt 2. The feed tray 3 can house a plurality of sheets of the recording medium P in a stack. The paper feed roller 4 picks-up one sheet of the recording medium P from the stack to feed the sheet downstream.

The intermediate transfer belt 2 is an intermediate transfer element that receives toner images from the electrophotographic processing units 10K, 10Y, 10M, and 10C and transfers the toner images to the recording medium P. The intermediate transfer belt 2 is wound around a pair of rollers 2A and 2B. The intermediate transfer belt 2 is rotated by a drive unit (not shown) in a direction indicated by an arrow K in FIG. 1 at a predetermined rotational speed.

The electrophotographic processing units 10K, 10Y, 10M, and 10C, each of which is an image forming unit, contains toner to form a single-color image (toner image) of a corresponding color. The electrophotographic processing units 10K, 10Y, 10M, and 10C are provided in this order along the rotating direction of the intermediate transfer belt 2 and form images of black (K), yellow (Y), magenta (M), and cyan (C), respectively. The electrophotographic processing units 10K, 10Y, 10M, and 10C are structurely similar to one another with an exception of the toner color. The structure of the electrophotographic processing unit 10K for forming an image in black toner will be described below as a representative example.

The photosensitive element 11K is a drum (image carrier) that carries an image on an outer surface of the drum and is located on the upper surface of the intermediate transfer belt 2. The photosensitive element 11K is rotated by a rotation drive unit (not shown) such as a motor about a rotary axis of the photosensitive element 11K at a predetermined velocity. On the photosensitive element 11K, an image is formed as follows. First, the charging unit 12K uniformly charges the outer surface (i.e., a photosensitive surface to be scanned) in a dark environment. The optical scanning unit 20 scans the charged outer surface with the light beam BK moving in the main-scanning direction according to black-image data for exposure. Each time the optical scanning unit 20 scans one main-scanning line, the photosensitive element 11K is rotated in the sub-scanning direction, which is perpendicular to the main-scanning direction, by a predetermined angle. This angle is determined based on a resolution in the sub-scanning direction. As the photosensitive element 11K thus rotates, scanning and exposure are repeated to form a two-dimensional latent image on the outer surface of the photosensitive element 11K.

The developing unit 13K supplies black toner, which is a developing agent, to the latent image formed on the photosensitive element 11K and develops the latent image into a visible, black toner image. The intermediate transfer belt 2 is interposed between the photosensitive element 11K and a primary transfer roller (now shown). The primary transfer roller transfers the toner image formed on the photosensitive element 11K to the intermediate transfer belt 2. Hence, the mono-color (black toner) image is formed on the intermediate transfer belt 2.

Subsequently, images of the other colors similarly formed by the electrophotographic processing units 10Y, 10M, and 10C are sequentially transferred onto the intermediate transfer belt 2, which is being rotated, in a superimposing manner. The thus-formed full-color image on the intermediate transfer belt 2 is moved, as the intermediate transfer belt 2 rotates, to reach the secondary transfer roller 5. The secondary-transfer roller 5 transfers the full-color image to the recording medium P fed by the paper feed roller 4 in synchronization with the toner image from the feed tray 3.

Thereafter, the not-yet-fixed toner image on the recording medium P is subjected to heat and pressure while passing through a nip between a pair of a pressure roller 6A and a fixing roller 6B in the fixing unit 6 (in a direction indicated by an arrow V in FIG. 1), to thus be fixed onto the recording medium P.

The optical scanning unit 20 has the light source and the deflecting unit. The light source is turned on and off to emit light beams according to image data. When the light beam enters from one reflection surface of the polygon mirror 21 to another as the polygon mirror rotates, the light beam is reflectively deflected to from one photosensitive element to another. In this manner, the optical scanning unit 20 can scan each of the photosensitive elements 11K, 11Y, 11M, and 11C by using the single LD 30 and the single polygon mirror 21. The image forming apparatus 1 includes a scan-start-synchronization control sensor 33 and the scan-end-synchronization control sensor 36, which are located at the scan-start region and the scan-end region, respectively, of the raster scan area. Light beams BS1 and BS2 are reflectively deflected by the polygon mirror 21 to impinge on the scan-start-synchronization control sensor 33 and the scan-end-synchronization control sensor 36, respectively.

Figure 2:
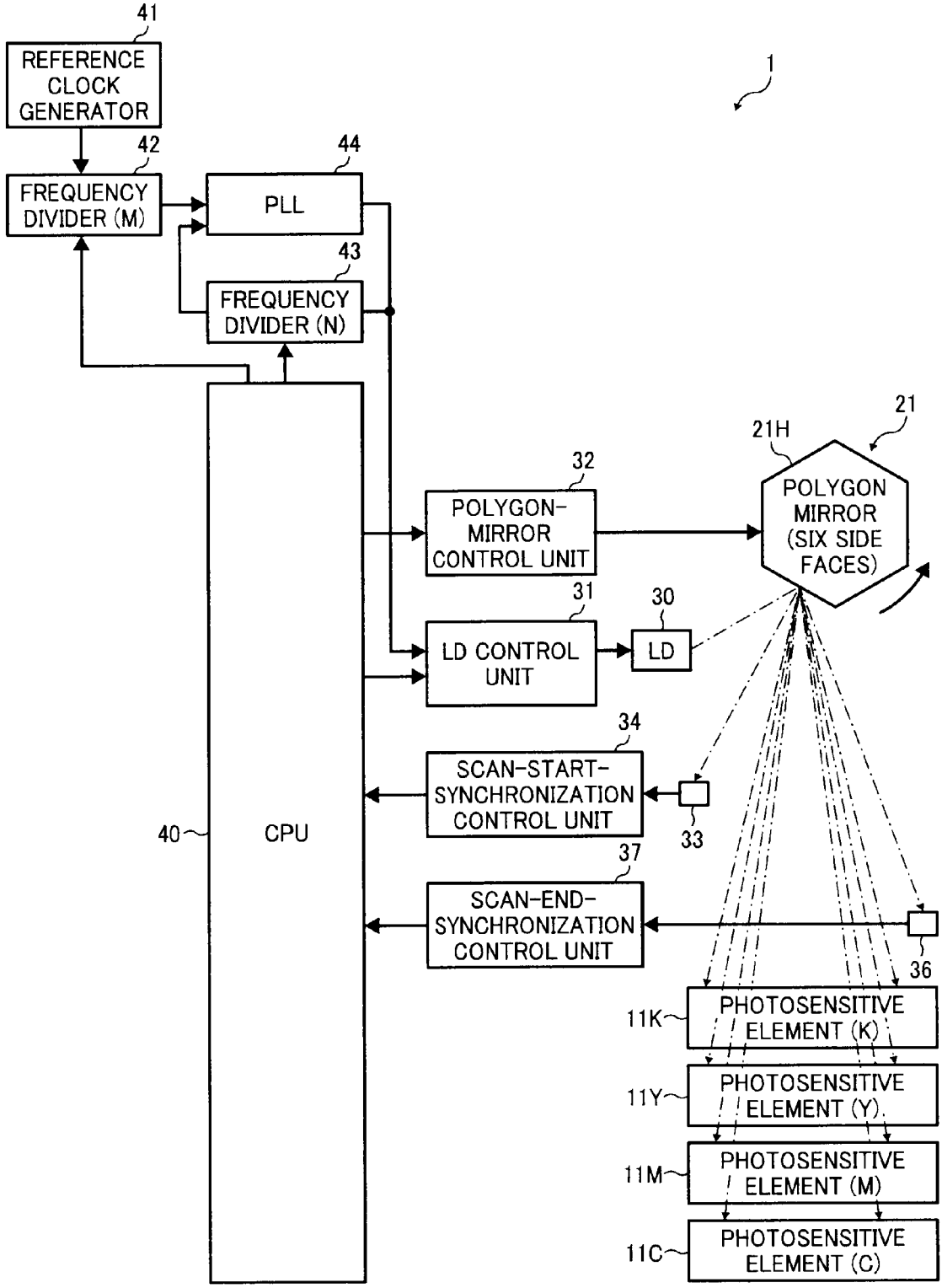
FIG. 2 is a block diagram of relevant parts of the image forming apparatus shown in FIG. 1.

FIG. 2 is a block diagram of the polygon mirror 21 and other relevant parts of the image forming apparatus 1. In the image forming apparatus 1, a single LD 30 is employed as the light source. The LD 30 emits a single light beam aiming at one of the reflection surfaces 21H of the polygon mirror 21 that is rotating at the predetermined rotational speed. The image forming apparatus 1 includes the polygon-mirror control unit 32 and an LD control unit 31. The polygon-mirror control unit 32 controls rotation of the polygon mirror 21 by controlling a rotation drive unit (not shown) of the polygon mirror 21. The LD control unit 31 controls the LD 30 so that the LD 30 emits light beams according to image data.

The image forming apparatus 1 further includes the CPU 40, a scan-start-synchronization control unit 34, and the scan-end-synchronization control unit 37. The CPU 40 performs various data processing, calculation, and control operations of the image forming apparatus 1. The scan-start-synchronization control unit 34 performs synchronization control of a light beam based on detection of the light beam by the scan-start-synchronization control sensor 33. The scan-end-synchronization control unit 37 performs synchronization control of the light beam based on detection of the light beam by the scan-end-synchronization control sensor 36. The image forming apparatus 1 further includes various memory (not shown) such as RAM, which is working memory of the CPU 40, and ROM that stores therein various data and computer programs. The image forming apparatus 1 performs various operations and processing related to image forming based on the computer programs and signals supplied from various sensors under control of the CPU 40.

The image forming apparatus 1 still further includes the reference clock generator 41, the frequency divider (M) 42, the frequency divider (N) 43, and the PLL 44. The reference clock generator 41 generates reference clock signals. The frequency divider (M) 42, the frequency divider (N) 43, and the PLL 44 change (adjust) a clock speed; for example, they change (adjust) pixel clock signals based on the clock signals. The image forming apparatus 1 changes parameters related to a divider circuit of the PLL 44 so that the clock signals for use in control of emission of light beams from the LD 30 are changed appropriately. The LD control unit 31 receives the changed clock signals and changes various parameters based on the clock signals, image data, a predetermined computer program, and various preset conditions. The changed parameters cause the LD 30 to emit light beams conforming to the image data and a rotation angle of the polygon mirror 21. The parameters include a light-emitting period of time, over which the LD 30 is to emit a light beam, a time interval between the light-emitting periods, and parameters related to timing when the LD 30 is to start emission of a light beam and to stop emission of a light beam.

As shown in FIG. 2, in the image forming apparatus 1, the polygon mirror 21 is generally hexagonal in plan view. The polygon mirror 21 has the six reflection surfaces (deflecting surfaces) 21H along the rotating direction of the polygon mirror 21.

Figure 3:
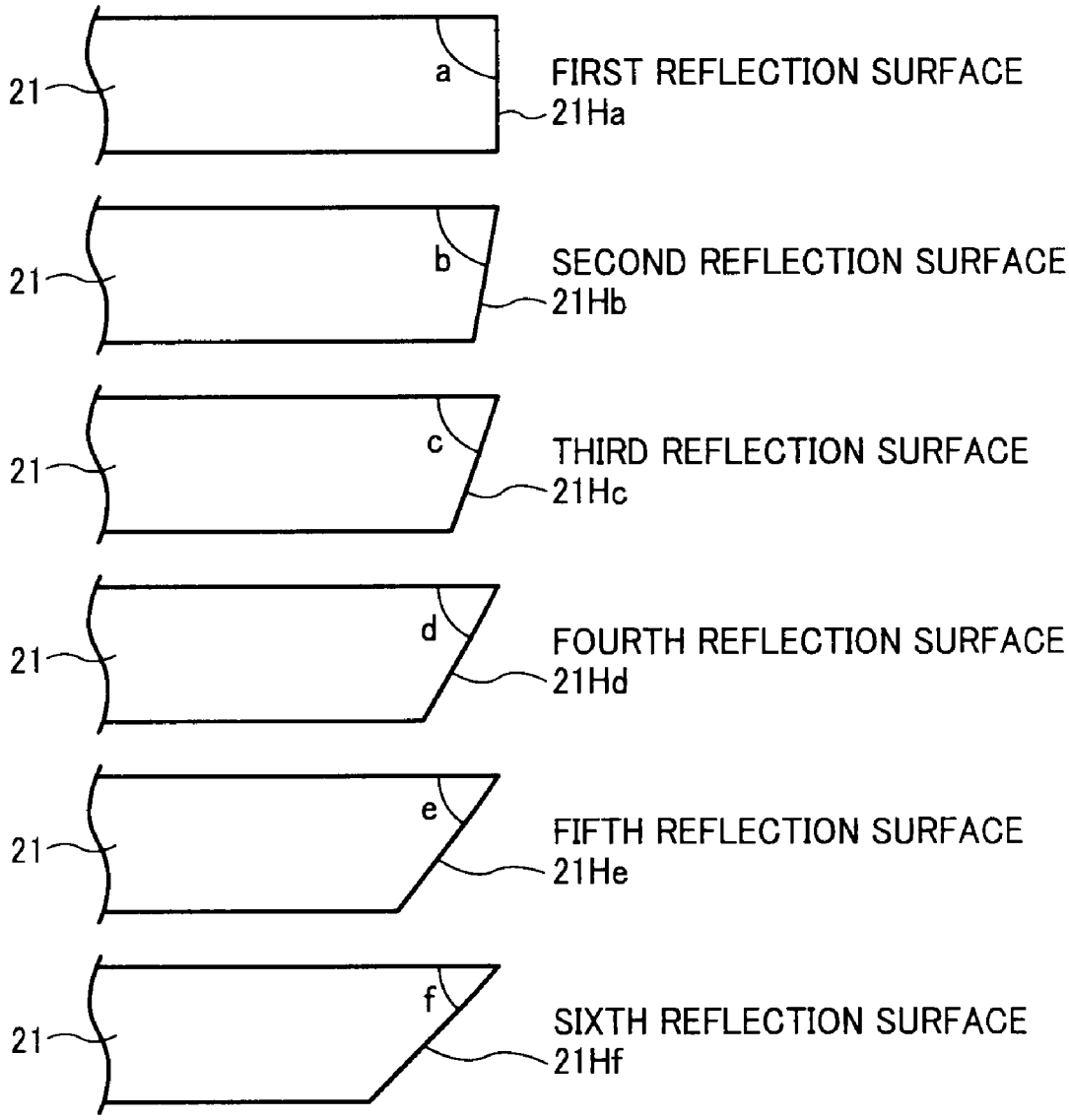
FIG. 3 depicts partial cross sections of six reflection surfaces of a polygon mirror of the image forming apparatus shown in FIG. 1.

FIG. 3 depicts vertical cross sections of the reflection surfaces 21H, each taken along a plane including a rotary axis of the polygon mirror 21. The reflection surfaces 21H, more specifically first to sixth reflection surfaces 21Ha to 21Hf are arranged sequentially in this order. Angles between a top surface of the polygon mirror 21 and the first to sixth reflection surfaces 21Ha to 21Hf are called angles a to f, respectively. The reflection angles a to f gradually become shaper from the greatest reflection angle a, which is substantially a right angle, of the reflection surfaces 21Ha to the sharpest reflection angle f of the reflection surfaces 21Hf. Accordingly, a light beam emitted from the LD 30 is reflectively deflected by one of the reflection surfaces 21Ha to 21Hf at a corresponding one of the reflection angles a to f as the polygon mirror 21 rotates.

As shown in FIG. 2, the deflected light beams sequentially impinge on the photosensitive elements 11K, 11Y, 11M, and 11C for raster scan and exposure and impinge on the scan-start-synchronization control sensor 33 and the scan-end-synchronization control sensor 36. More specifically, during one rotation of the polygon mirror 21, each of the photosensitive elements 11K, 11Y, 11M, and 11C is raster-scanned for a single scan line, and each of the scan-start-synchronization control sensor 33 and the scan-end-synchronization control sensor 36 detects an incident light beam.

The polygon mirror 21 has the plurality of reflection surfaces 21H corresponding to the plurality of (in the first embodiment, four) photosensitive elements. The polygon mirror 21 reflects the light beams BK, BY, BM, and BC emitted from the single light source at different reflection angles, whereby an optical path is switched from one to another.

As shown in FIG. 1, the reflected light beams BK, BY, BM, and BC are guided by using reflection mirrors 14K, 14Y, 14M, and 14C, respectively, to the photosensitive elements 11K, 11Y, 11M, and 11C to raster scan the photosensitive elements 11K, 11Y, 11M, and 11C for exposure.

The polygon mirror 21 has the two reflection surfaces 21He and 21Hf corresponding to the scan-start-synchronization control sensor 33 and the scan-end-synchronization control sensor 36. The angles e and f of the two reflection surfaces 21He and 21Hf differ from each other, as well as from the reflection angles a to d of the reflection surface 21H for the four photosensitive elements 11K, 11Y, 11M, and 11C. A light beam emitted from the light source and reflected at the angle e from the fifth reflection surface 21He impinges on the scan-end-synchronization control sensor 36; and a light beam emitted from the light source and reflected at the angle f from the fifth reflection surface 21Hf impinges on the scan-start-synchronization control sensor 33.

The image forming apparatus 1 performs synchronization control based on detection of a light beam by the scan-start-synchronization control sensor 33. More specifically, for example, a scan-start position is adjusted in the main-scanning direction by controlling a write timing of the light beam that scans one of the photosensitive elements 11K, 11Y, 11M, and 11C. The image forming apparatus 1 also corrects magnification in the main-scanning direction and registration errors in the sub-scanning direction based on detection of a light beam by the scan-start-synchronization control sensor 33.

The image forming apparatus 1 also performs correction of a light beam to be deflected by the polygon mirror 21 by controlling emission of the light beam from the LD 30 rather than by using an fθ lens. This correction will be referred to as "fθ correction" and will be described in detail below.

Figure 4:
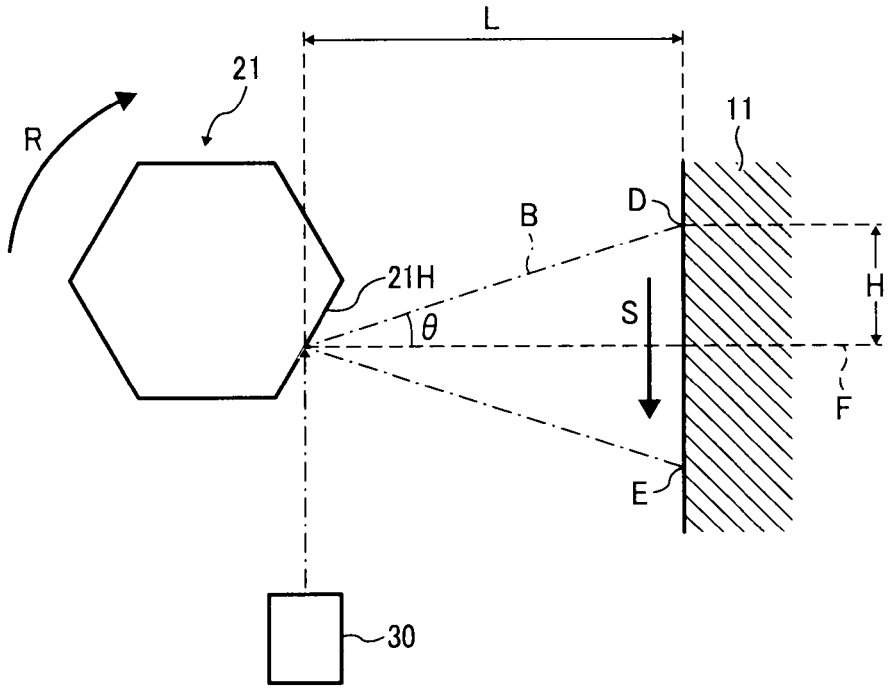
FIG. 4 schematically depicts how a light beam scans a photosensitive element after being deflected on the polygon mirror, which is rotating.

FIG. 4 schematically depicts how an optical path of a light beam B shifts. The light beam B is emitted from the LD 30 and deflected by the reflection surface 21H of the polygon mirror 21 so that the light beam B impinges on the photosensitive element 11 for raster scan. When the polygon mirror 21 that receives the light beam B is rotating at a constant angular velocity in the direction indicated by an arrow R in FIG. 4, the light beam B is reflected from the reflection surface 21H at a reflection angle that continuously changes. Accordingly, an exposure position of the light beam B on the photosensitive element 11 shifts from a first end D in the main-scanning direction while crossing over a center line F to a second end E. The center line F is a center line between the first end D and the second end E. The image surface (photosensitive surface) of the photosensitive element 11 is thus raster-scanned (vertically downward in FIG. 4 as indicated by an arrow S).

For this raster scanning, as follows:

$$H=L\times\tan\theta,$$

where θ is an angle between a normal to the image surface of the photosensitive element 11 and the light beam B; H is an image height of the light beam B from the center line F, at which θ=0 (in other words, H is a distance between the center line F and the exposure position on the image surface); and L is a distance between a position at which the light beam B impinges on the reflection surface 21H and a point of intersection of the center line F and the image surface (i.e., a foot of the normal line on the image surface).

As the angle θ continuously changes along with rotation of the polygon mirror 21, the main-scan speed per unit time of the light beam B on the image surface varies. In other words, a change in H per unit time depends on the position of the light beam B on the image surface in the main-scanning direction.

Figure 5:
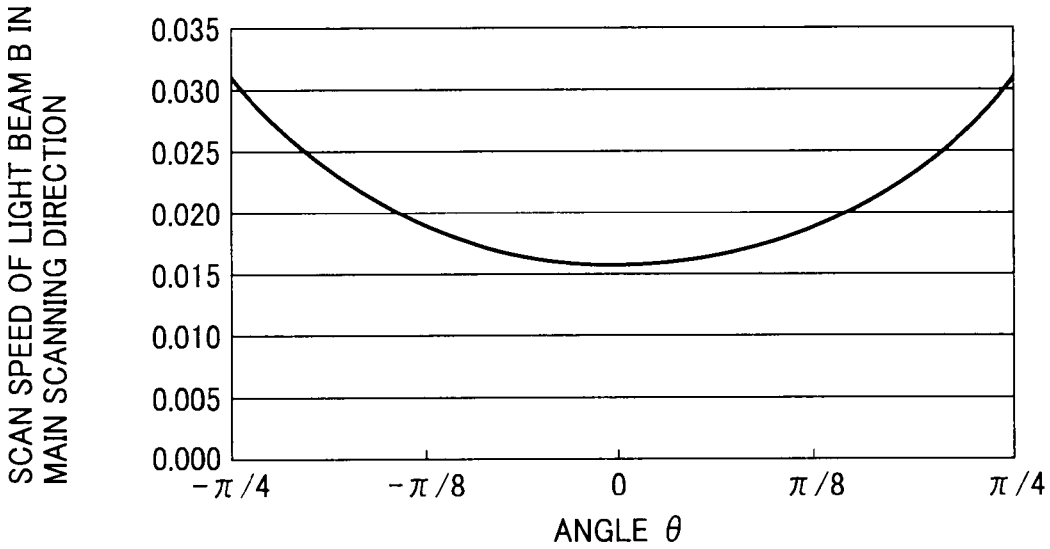
FIG. 5 is an exemplary graph that shows how a scan speed of a light beam in the main-scanning direction changes relative to angle θ.

FIG. 5 is an exemplary graph showing a relation between scan speed plotted along the vertical axis and angle θ plotted along the horizontal axis. FIG. 5 shows relative scan speed of the light beam B, with the angle θ varied from −π/4 to π/4 in increments of π/200, and L=1.

It is clear from FIG. 5 that the main-scan speed of the light beam B is the minimum at a point where θ=0 and gradually increases from this point in a generally symmetric curve about this point. The main-scan speed at a point where θ=−π/4 or θ=π/4 is approximately double of the main-scan speed at the point where θ=0. Because the main-scan speed of the light beam B depends on the angle θ, a length of a pixel formed by the light beam B on the photosensitive element 11 and an interval between adjacent pixels also depend on a position of the pixel in the main-scanning direction. Accordingly, a pixel density on the photosensitive element 11 varies such that the density value is the greatest at the point where θ=0 and gradually decreases from the point as an absolute value of θ increases. Hence, dots on a resultant image are uneven in the main-scanning direction.

To avoid occurrence of such uneven dots, the LD control unit 31 controls emission of a light beam from the LD 30 to compensate for the variation in the main-scan speed of the light beam B.

More specifically, the LD control unit 31 controls (changes), based on a preset condition, various parameters of the LD 30. For this control, the LD control unit 31 takes an exposure condition of each of the photosensitive elements 11K, 11Y, 11M, and 11C, and the like, into consideration. The parameters include the light-emitting period, the time interval between the light-emitting periods, and parameters related to timing when the LD 30 is to start emission of a light beam and to stop emission of a light beam. The LD control unit 31 controls the LD 30 so that a variation in the main-scan speed of the light beam B is cancelled. For example, the LD control unit 31 can set the parameters such that the greater the absolute value of θ, the smaller the light-emitting period and the time interval.

The image forming apparatus 1 performs the fθ correction of a light beam, which is to be reflectively deflected on the reflection surface 21H of the polygon mirror 21. The light beam is corrected such that the light beam scans the image surface of the photosensitive element 11 at a constant velocity, rather than at a constant angular velocity, whereby avoiding occurrence of uneven dots on a resultant image.

An image forming method, including image forming processes and operations related to the processes, to be performed by the image forming apparatus 1 will be described below.

Figure 6:
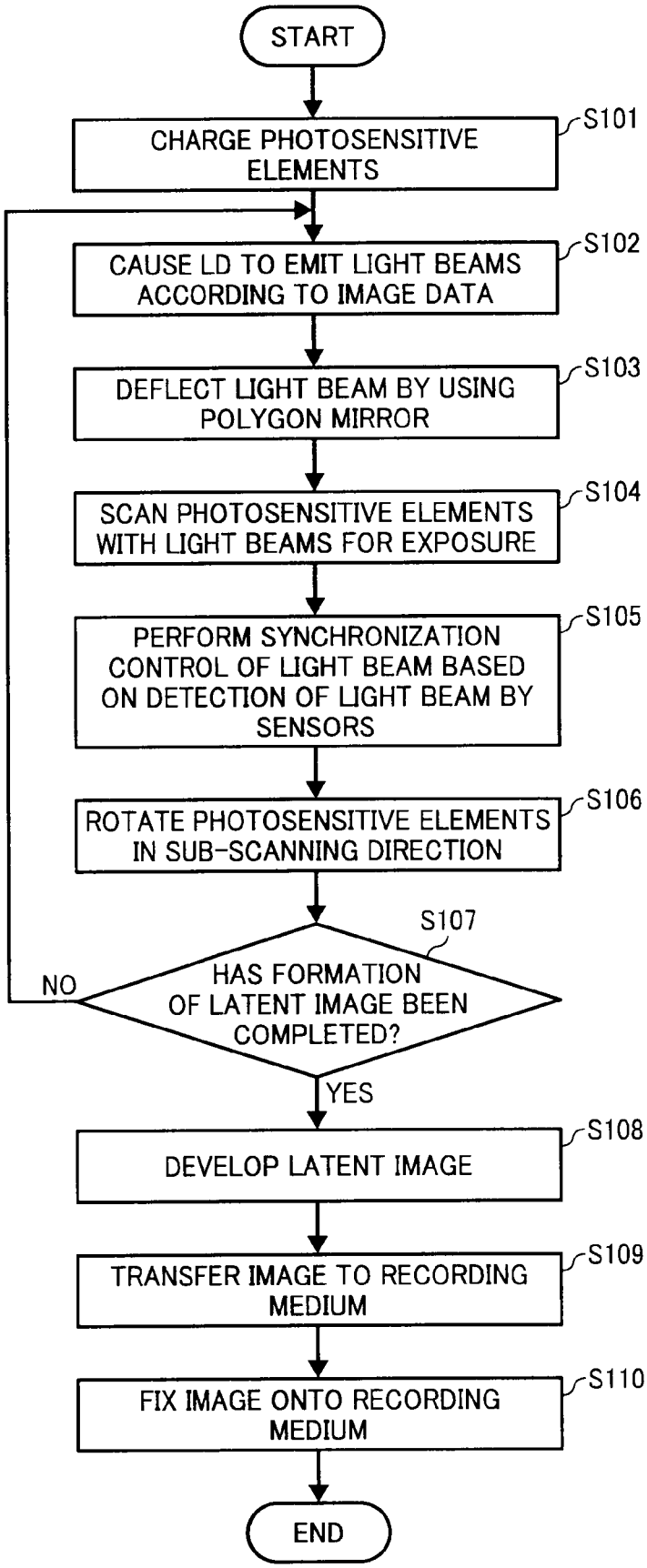
FIG. 6 is a flowchart of an image forming process performed by the image forming apparatus shown in FIG. 1.

FIG. 6 is a flowchart of an image forming process performed by the image forming apparatus 1. The charging units 12K, 12Y, 12M, and 12C charge outer surfaces of the photosensitive elements 11K, 11Y, 11M, and 11C uniformly (Step S101). The LD control unit 31 controls emission of the light beams BK, BY, BM, BC, BS1, and BS2 from the LD 30 according to image data, whereby the LD control unit 31 performs the fθ correction of the light beams BK, BY, BM, BC, BS1, and BS2 (Step S102). The light beams BK, BY, BM, BC, BS1, and BS2 are reflected from the reflection surfaces 21Ha to 21Hf at the reflection angles a to f, whereby the optical path is switched from one to another (Step S103).

As described above, the light beam is reflected from one of the four reflection surfaces 21Ha to 21Hd for the multiple (in this embodiment, four) photosensitive elements 11K, 11Y, 11M, and 11C and the two reflection surfaces 21He and 21Hf. The angles a to f of the reflection surfaces 21Ha to 21Hf differ from one another. Hence, by being subjected to the fθ correction, each of the light beams BK, BY, BM, and BC is guided to one of the photosensitive elements 11K, 11Y, 11M, and 11C along one of the optical paths to perform raster scan and exposure (Step S104).

The light beam BS1 is reflected from the reflection surface 21Hf for the scan-start-synchronization control sensor 33; and the light beam BS2 is reflected from the reflection surface 21He for the scan-end-synchronization control sensor 36. A scan-start position and a scan-end position of the light beams BK, BY, BM, and BC are adjusted based on detection of the light beam BS2 by the scan-start-synchronization control sensor 33 and detection of the light beam BS1 by the scan-end-synchronization control sensor 36 for synchronization (Step S105).

The photosensitive elements 11K, 11Y, 11M, and 11C are rotated in the sub-scanning direction (Step S106). Whether formation of a latent image has been completed is determined (Step S107). If formation of the latent has yet to be completed (No at Step S107), processing control returns to Step S102 to repeat the above procedure. During the course of the procedure, a light beam emitted from the single light source according to image data is deflected by the single polygon mirror 21 that is rotating in the main-scanning direction. Hence, light beams sequentially scan the photosensitive elements 11K, 11Y, 11M, and 11C for exposure.

When formation of the latent image has completed (Yes at Step S107), each of the developing units 13K, 13Y, 13M, and 13C develops one of the latent images of the corresponding color to form a visible image (Step S108). All of the images are transferred to the intermediate transfer belt 2 in a superimposing manner to form a full-color image. The full-color image is then transferred to the recording medium P (Step S109). The fixing unit 6 fixes the image onto the recording medium P (Step S110), and the process ends.

The image forming method according to the first embodiment can be implemented with a computer program described in a general program language for causing a computer to execute the processes (steps). The computer program can be easily implemented by recording the computer program in a desired computer-readable recording medium, such as a flexible disk, a compact disc-read-only memory (CD-ROM), a digital versatile disk-read only memory (DVD-ROM), or a read only memory (ROM), and causing a computer to read the computer program.

In the image forming apparatus 1, the light source is embodied with the single LD 30, and the plurality of photosensitive elements 11K, 11Y, 11M, and 11C are scanned for exposure by using the single polygon mirror 21. Accordingly, the number of required parts for construction of the image forming apparatus 1 can be reduced. Furthermore, each of the photosensitive elements 11K, 11Y, 11M, and 11C is scanned with a light beam reflected by the corresponding one of the reflection surfaces 21Ha to 21Hd of the polygon mirror 21. Accordingly, the need of performing the optical-face-angle error correction, which may otherwise be required to correct a dimensional error developed during a manufacturing process, for the reflection surfaces 21H is eliminated. Because the fθ correction of the light beam can be performed by controlling light emission from the LD 30, the need of providing a relatively high-priced fθ lens in the image forming apparatus 1 is also eliminated, as well as the number of necessary parts is reduced. Hence, cost reduction and downsizing of the image forming apparatus can be achieved while maintaining an image quality of a resultant image.

The polygon mirror 21 has the two reflection surfaces 21Hf and 21He dedicated for the scan-start-synchronization control sensor 33 and the scan-end-synchronization control sensor 36, i.e., for the light beams BS1 and BS2, in addition to the four reflection surfaces 21Ha to 21Hd for the photosensitive elements. Because a wider area can be ensured as the raster scan area, the effective scan ratio of a deflected light beam is increased. Put another way, a ratio of a width of the image writing area to a single raster-scan stroke of the light beam can be increased. Accordingly, the polygon mirror 21, which is a necessary component for image writing, can be downsized. Furthermore, an increase in the effective scan ratio is advantageous in terms of arrangement of the optical system in the image forming apparatus 1, leading to downsizing of the optical system. Hence, effective improvement of the image forming apparatus 1 in terms of size and cost is yielded. Still furthermore, because synchronization control is performed by using the scan-start-synchronization control sensor 33 and the scan-end-synchronization control sensor 36, accuracy in scanning is improved. Build-up in power consumption and unnecessary radiation, which can occur when a write frequency increases, can also be avoided, leading to a reduction in running cost.

In this manner, the image forming apparatus 1 can achieve improvement in terms of size and cost while increasing image quality.

Meanwhile, scanning each of the photosensitive elements 11K, 11Y, 11M, and 11C for a single main-scanning line requires one turn of the polygon mirror 21. Because the polygon mirror 21 according to the first embodiment can be downsized and reduced in weight, the rotation speed of the polygon mirror 21 can be increased. As the rotation speed increases, the main-scan speed increases, whereby demands for image forming at higher speeds can be satisfied.

Such demands for higher speeds can alternatively be satisfied by employing a multi-beam LD capable of generating multiple light beams simultaneously. The photosensitive elements 11K, 11Y, 11M, and 11C can be raster-scanned concurrently by using multiple light beams emitted from the multi-beam LD and reflectively deflected by the polygon mirror 21. By employing such a light source capable of independently emitting multiple light beams according to image data, the light beams can be controlled independently, whereby image forming can be accelerated relatively easily without increasing the rotation speed of the polygon mirror 21. In this case, the light beams are independently controlled and concurrently emitted from the light source toward the polygon mirror 21. After being reflectively deflected by a single reflection surface 21H of the polygon mirror 21, each of the light beams scans a corresponding one of the photosensitive elements 11K, 11Y, 11M, and 11C.

The polygon mirror 21 has one reflection surface for each of the photosensitive elements 11K, 11Y, 11M, and 11C; however, the polygon mirror 21 can have two or more reflection surfaces for each of the photosensitive elements 11K, 11Y, 11M, and 11C. The lengths (hereinafter, "lateral length"), taken along the rotating direction of the polygon mirror 21 of the reflection surfaces 21H, can be equal to one another or different from one another, as required. Meanwhile, the two reflection surfaces 21He and 21Hf can satisfactorily reflect light beams so as to be received by the corresponding sensors even when main-scanning lengths of light beams aimed at the two reflection surfaces 21He and 21Hf are smaller than main-scanning lengths of light beams aiming at the other reflection surfaces 21Ha to 21Hd for use in image writing. Therefore, the lateral lengths of the reflection surfaces 21He and 21Hf can be smaller than the other reflection surfaces 21Ha to 21Hd. When the polygon mirror 21 is configured in such a manner, the polygon mirror 21 can be more compact. Such a compact polygon mirror can be constructed by causing the reflection surfaces 21He and 21Hf to be smaller in lateral length than the other reflection surfaces (in this example, the reflection surfaces 21Ha to 21Hd).

When distances from the image surfaces of the photosensitive elements 11K, 11Y, 11M, and 11C to corresponding ones of the reflection surfaces 21Ha to 21Hd of the polygon mirror 21 differ from one another, main-scan speeds of light beams (fθ characteristics) for the angle θ differ from one another accordingly (see FIG. 5). More specifically, when the angle θ is unchanged, the greater the scan speed, the greater the distance with the fθ characteristics changing accordingly. Accordingly, it is preferable to control emission of a light beam from the LD 30 depending on the distance.

Figure 7:
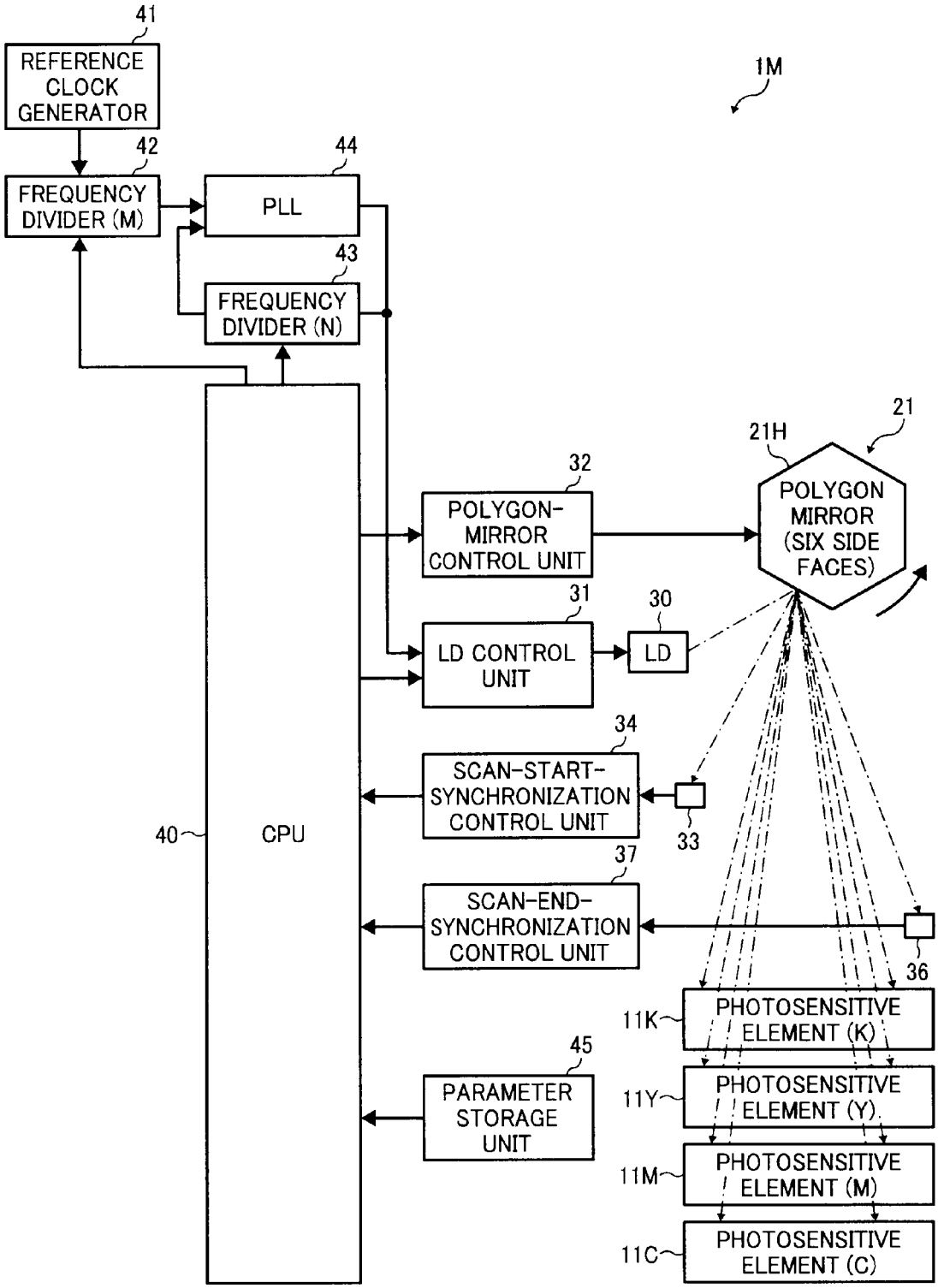
FIG. 7 is a block diagram of relevant parts of an image forming apparatus according to a second embodiment of the present invention.

FIG. 7 is a block diagram of relevant parts of an image forming apparatus 1M according to a second embodiment of the present invention. The image forming apparatus 1M controls emission of a light beam depending on the distance. The image forming apparatus 1M includes a parameter storage unit 45 in addition to the components of the image forming apparatus 1 (see FIG. 2). The parameter storage unit 45 stores therein various parameters related to the fθ characteristics on a distance-by-distance basis. The parameters are calculated and determined in advance for each of various conditions.

For instance, for L1 and L2, each of which is a distance from one of the reflection surfaces 21H to one of image surfaces of the photosensitive elements 11K, 11Y, 11M, and 11C, image heights H1 and H2 are calculated from: H1=L1× tan θ, and H2=L2×tan θ. Values of L1/L2 are stored in the parameter storage unit 45 as the parameter for correcting H1 relative to H2 by controlling light emission from the LD 30 and the time intervals.

The image forming apparatus 1M causes the LD control unit 31 to control emission of a light beam based on the parameters read from the parameter storage unit 45. More specifically, the LD control unit 31 controls emission of a light beam from the LD 30 based on the distances (in this example, L1 and L2) each taken from one of the reflection surfaces 21Ha to 21Hd to one of the image surfaces of the photosensitive elements 11K, 11Y, 11M, and 11C.

For example, if L1:L2=1:2 holds, the parameter L1/L2 is calculated to be ½. Hence, the variation in the distance can be compensated by controlling the light-emitting period, the time intervals, or the like based on the parameter value of ½.

As described above, the fθ correction of the light beam is performed depending on the distance from each of the reflection surfaces 21H to each of the image surfaces. By performing such a compensation for the distance, the fθ correction of the light beam can be performed more appropriately, and accuracy in scanning can be improved, which leads to further improvement of image quality.

Alternatively, it is possible to employ a guide unit 50 that causes the lengths of optical paths from the each of the reflection surfaces 21Ha to 21Hd to the corresponding one of the image surfaces of the polygon mirror 21 to be equal to one another. By employing the guide unit 50, the parameters related to the distances can be equalized, whereby the LD control unit 31 can control emission of light beams from the LD 30 under a uniform condition.

Figure 8:
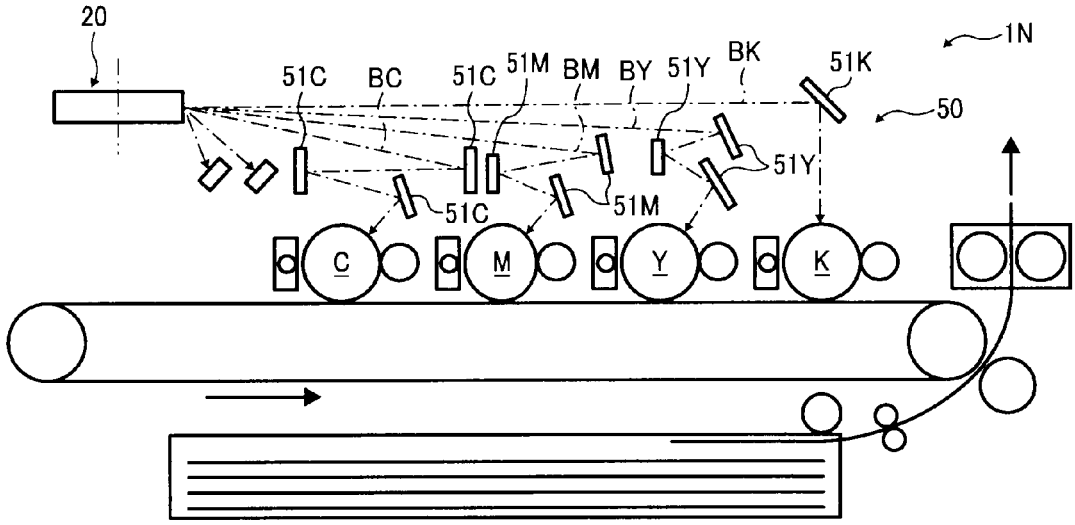
FIG. 8 is a schematic diagram of an image forming apparatus according to a third embodiment of the present invention.
Figure 9:
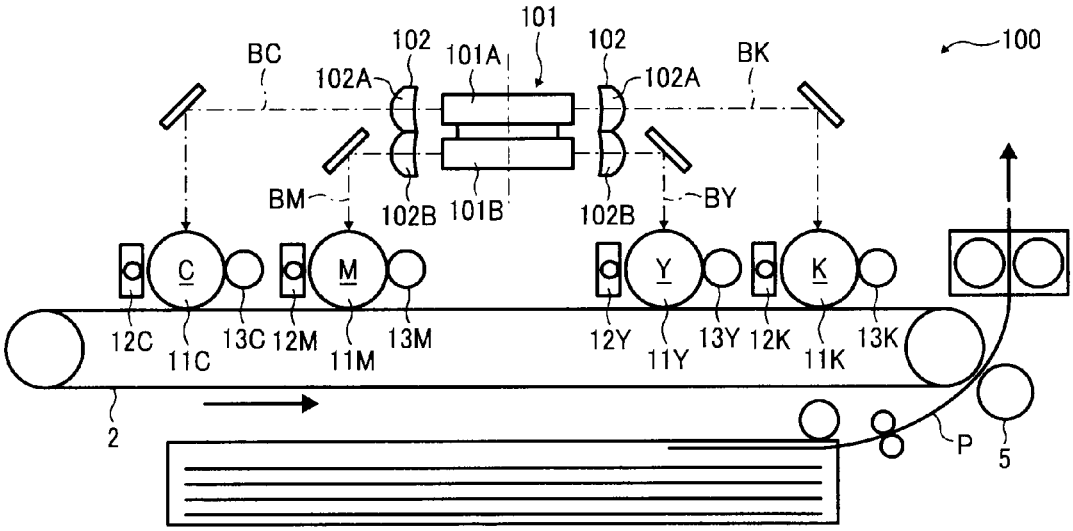
FIG. 9 is a schematic diagram of relevant parts of a conventional image forming apparatus.
Figure 10:
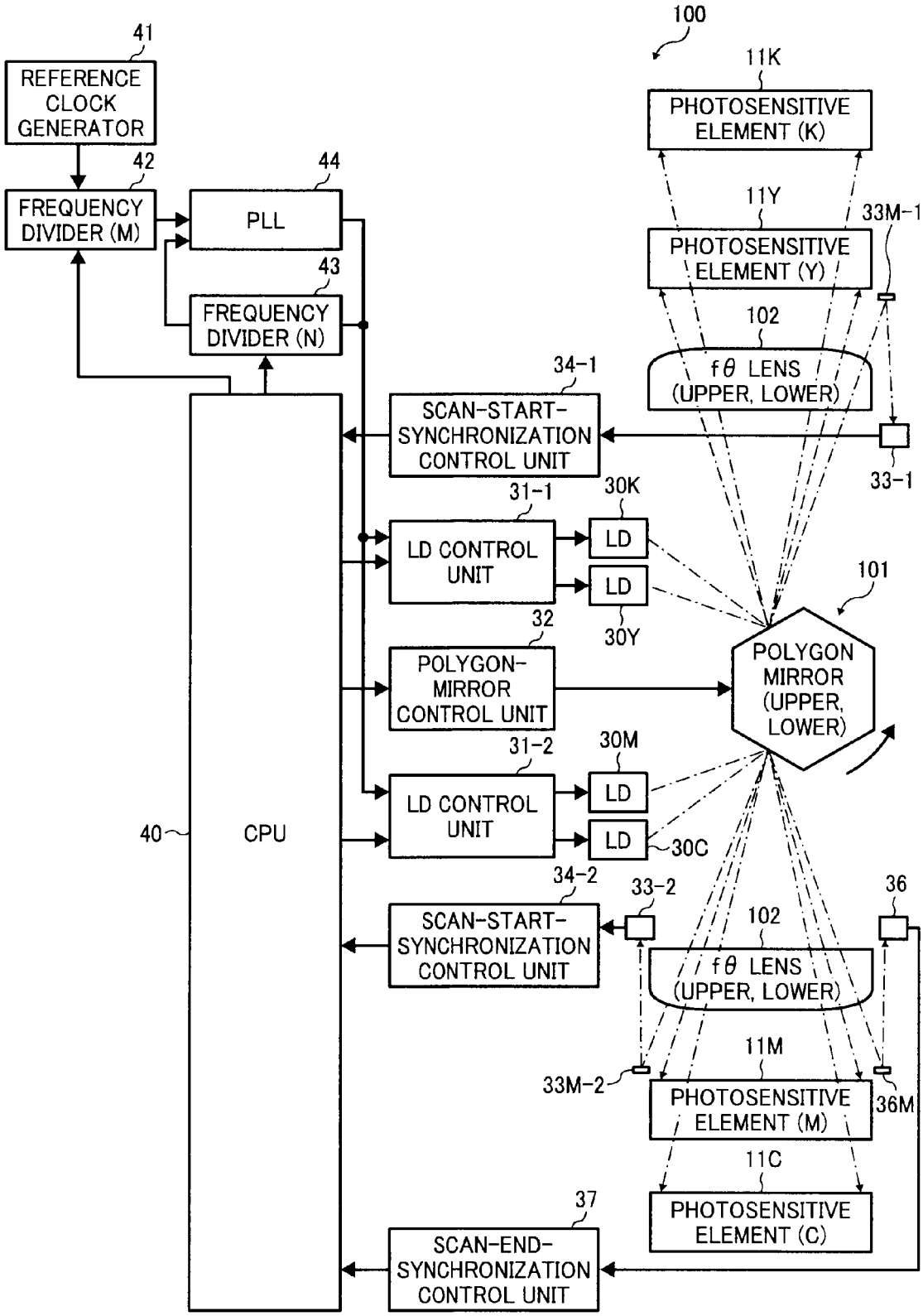
FIG. 10 is a block diagram of relevant parts of the image forming apparatus shown in FIG. 9.

FIG. 8 is a schematic diagram of relevant parts of an image forming apparatus 1N according to a third embodiment of the present invention. The image forming apparatus 1N includes the guide unit 50 in addition to the components of the image forming apparatus 1 (see FIG. 1). The guide unit 50 includes one or more reflection mirrors 51K, 51Y, 51M, and 51C on the optical paths of the light beams BK, BY, BM, and BC. The light beam BK is reflected from the single reflection mirror 51K; and each of the light beams BY, BM, and BC is reflected from a corresponding one of the reflection mirrors 51Y, 51M, and 51C. Each of the reflection mirrors 51Y, 51M, and 51C includes three mirrors.

The image forming apparatus 1N thus causes the lengths of the optical paths from each of the reflection surfaces 21Ha to 21Hd to the image surfaces of the photosensitive elements 11K, 11Y, 11M, and 11C to be equal to one another by guiding the light beams BK, BY, BM, and BC to undergo one or more reflections. Accordingly, the image forming apparatus 1N can provide the similar advantage to that provided by the image forming apparatus 1M. More specifically, accuracy in scanning can be improved, which leads to further improvement of image quality. In addition, a scheme for controlling emission of a light beam can be simplified because the control can be performed under a uniform condition.

The above embodiments have been described with reference to the example structure for controlling emission of light beams from the single LD 30 depending on the distances from the reflection surfaces 21H to the image surfaces of the photosensitive elements 11K, 11Y, 11M, and 11C. The emission of light beams can be controlled by changing the light-emitting periods and the time intervals of the LD 30. However, the invention is not limited to this structure. For example, the invention can be applied to a configuration that uses a plurality of LDs. In this case, emission of a light beam can be controlled depending on a distance from each of the LDs to each of the image surfaces.

The above embodiments have been described with reference to a tandem-type image forming apparatus taken as an example. However, the present invention can be applied to any other image forming apparatus (method) that deflects a light beam emitted from a light source according to image data in the main-scanning direction by using a rotating polygon mirror to scan a plurality of photosensitive elements for exposure.

According to an aspect of the present invention, an image forming apparatus that forms an image by exposing a plurality of photosensitive elements to light beams can be downsized while forming the image with improved image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image according to image data, the image forming apparatus comprising:

a light source that emits a light beam according to the image data;

a deflecting unit that receives the light beam from the light source and deflects the light beam in a main-scanning direction;

a scan-start-synchronization control sensor that detects the light beam near a scan-start position in the main-scanning direction;

a scan-end-synchronization control sensor that detects the light beam near a scan-end position in the main-scanning direction;

a plurality of photosensitive elements that are exposed to the light beam received from the deflecting unit; and a light-beam control unit that controls an emission of the light beam from the light source depending on a distance between the deflecting unit and the photosensitive elements, thereby performing an fθ correction of the light beam, wherein the deflecting unit includes a rotatable polygon mirror having a plurality of first reflection surfaces, each corresponding to one of the photosensitive elements, the rotatable polygon mirror having two second reflection surfaces, one of the second reflection surfaces receives the light beam and reflects the light beam to the scan-start-synchronization control sensor, an other of the second reflection surfaces receives the light beam and reflects the light beam to the scan-end-synchronization control sensor, the first reflection surfaces reflect the light beam at reflection angles that differ from one another, the second reflection surfaces reflecting the light beam at reflection angles that differ from one another, and the second reflection surfaces are smaller than the first reflection surfaces in length in the main-scanning direction of the light beam.

2. An image forming method to be implemented on an image forming apparatus that forms an image according to image data, the image forming method comprising:

emitting, with a light source, a light beam according to the image data;

receiving, with a deflecting unit, the light beam from the light source, and deflecting the light beam in a main-scanning direction;

detecting, with a scan-start-synchronization control sensor, the light beam near a scan-start position in the main-scanning direction;

detecting, with a scan-end-synchronization control sensor, the light beam near a scan-end position in the main-scanning direction;

exposing a plurality of photosensitive elements to the light beam received from the deflecting unit; and controlling an emission of the light beam from the light source depending on a distance between the deflecting unit and the photosensitive elements, thereby performing an fθ correction of the light beam, wherein a rotatable polygon mirror having a plurality of first reflection surfaces, each corresponding to one of the photosensitive elements, is the deflecting unit, the rotatable polygon mirror having two second reflection surfaces, one of the second reflection surfaces receiving the light beam and reflecting the light beam to the scan-start-synchronization control sensor, an other of the second reflection surfaces receiving the light beam and reflecting the light beam to the scan-end-synchronization control sensor, the first reflection surfaces reflecting the light beam at reflection angles that differ from one another, the second reflection surfaces reflecting the light beam at reflection angles that differ from one another, and the second reflection surfaces are smaller than the first reflection surfaces in length in the main-scanning direction of the light beam.

3. A non-transitory, computer program product that causes a computer to implement a method of forming an image according to image data, the computer program product causing the computer to execute:

emitting, with a light source, a light beam according to the image data;

receiving, with a deflecting unit, the light beam from the light source, and deflecting the light beam in a main-scanning direction, the deflecting unit having two sensor reflection surfaces, the sensor reflection surfaces reflecting the light beam at reflection angles that differ from one another;

detecting, with a scan-start-synchronization control sensor, the light beam near a scan-start position in the main-scanning direction, one of the sensor reflection surfaces receiving the light beam and reflecting the light beam to the scan-start-synchronization control sensor;

detecting, with a scan-end-synchronization control sensor, the light beam near a scan-end position in the main-scanning direction, an other of the sensor reflection surfaces receiving the light beam and reflecting the light beam to the scan-end-synchronization control sensor;

exposing a plurality of photosensitive elements to the light beam received from the deflecting unit; and controlling an emission of the light beam from the light source depending on a distance between the deflecting unit and the photosensitive elements, thereby performing an fθ correction of the light beam.

* * * * *